US005738450A

United States Patent [19]

Lukosch

[11] Patent Number: 5,738,450

[45] Date of Patent: Apr. 14, 1998

[54] KEYBOARD WITH SIMPLIFIED SWITCH PAD HAVING A STABILIZATION ELEMENT

[75] Inventor: Klaus-Dieter Lukosch, Hirschau, Germany

[73] Assignee: Cherry Mikroschaller GmbH, Auerbach, Germany

[21] Appl. No.: 691,819

[22] Filed: Aug. 5, 1996

[30] Foreign Application Priority Data

Aug. 10, 1995 [DE] Germany ..... 195 29 492.0

[51] Int. Cl.[6] ..... B41J 5/12

[52] U.S. Cl. ..... 400/495; 400/479; 400/490; 200/512

[58] Field of Search ..... 400/473, 477, 400/479, 490, 495; 200/512

[56] References Cited

U.S. PATENT DOCUMENTS

| | | | |
|---|---|---|---|
| 5,386,091 | 1/1995 | Clancy | 200/512 |
| 5,430,263 | 7/1995 | English et al. | 200/512 |
| 5,438,177 | 8/1995 | Fagan | 200/512 |
| 5,516,996 | 5/1996 | Shin | 200/512 |
| 5,525,979 | 6/1996 | Engle et al. | 200/512 |

*Primary Examiner*—John S. Hilten
*Attorney, Agent, or Firm*—Klaus J. Bach

[57] ABSTRACT

In a keyboard comprising a housing including lower and upper housing parts wherein a metal plate, a switch foil set and a switch pad with resilient switch domes are disposed in the lower housing part and the upper housing part has keyboard keys slidably supported therein so as to be disposed on, and supported by said switch domes, the switch pad has openings formed therein between the switch domes such that the switch pad comprises a net-like structure in which the switch domes are interconnected by narrow webs and a plate-like stabilization element is disposed on the switch pad with openings at the locations of the switch domes wherein the switch domes are received in their proper positions below the respective switch domes.

3 Claims, 3 Drawing Sheets

KEYBOARD WITH SIMPLIFIED SWITCH PAD HAVING A STABILIZATION ELEMENT

BACKGROUND OF THE INVENTION

The invention relates to a keyboard with a switch pad and with a multi-layer switch foil set disposed in a housing wherein a metal plate is form-lockingly received between a bottom part of the housing and the lowermost switch foil and is firmly engaged in place.

Such a keyboard is described for example in U.S. patent application Ser. No. 08/397,477 which is assigned to the assignee of the present application. It provides for a keyboard which has a high rigidity with relatively little weight.

The elastomer switch pad used in these keyboards for the activation of the contact points of the switch foils consists of relatively expensive silicone elastomer. By using in the interior of the known keyboard an elastomer switch pad which fully covers the complete key area and which is provided in the area immediately below the key buttons with cupola-shaped switch domes for transmitting the switching actions to the switch foil contact points arranged below, the part of the manufacturing costs attributable to the continuous switch pad is relatively high. However, it is pointed out that changes which reduce the manufacturing cost component attributable to the switch pad should not result in a decrease in quality or any other property of a keyboard.

It is the object of the present invention to provide a keyboard with a switch pad and with a multi-layer switch foil set disposed in a housing in which a metal plate is form-lockingly received between a bottom part of the housing and the switch foil set wherein the switch pad is so designed that the manufacturing costs are reduced but neither the mechanical rigidity nor the reliability suffer by the design solutions.

SUMMARY OF THE INVENTION

In a keyboard comprising a housing including lower and upper housing parts a metal plate, a switch foil set and a switch pad with resilient switch domes are disposed in the lower housing part and the upper housing part has keyboard keys slideably supported therein so as to be disposed on, and supported by, said switch domes. The switch pad has openings formed therein between the switch domes such that the switch pad comprises a net-like structure in which the switch domes are interconnected by narrow webs and a plate-like stabilization element is disposed on the switch pad with openings at the locations of the switch domes wherein the switch domes are received and engaged in their proper positions below the respective switch domes.

It is pointed out that a reduction of the manufacturing cost components attributable to the elastomer switch pad alone by providing material cutouts in the pad is not sufficient since this would normally lead to an unstable arrangement for the remaining pad so that its switching functions would become unreliable.

However, with the arrangement according to the present invention neither rigidity nor reliability is sacrificed. It is particularly advantageous if reinforcement ribs formed on the upper housing part engage corresponding engagement elements formed on the lower housing part and the top housing part has projections which are engaged in receiving elements in the lower housing parts and the stabilizing element, the net-like switch pad, the switching foil set and the metal plate have opening through which the receiving elements extend.

With the keyboard according to the invention substantial smaller amounts of the relatively expensive elastomer switch board pad material is required while the keyboard remains very rigid and is highly reliable in operation.

The features and advantages of the invention will become more readily apparent from the following description of an embodiment thereof on the basis of the accompanying drawings.

DESCRIPTION OF A PREFERRED EMBODIMENT

Figure 1:
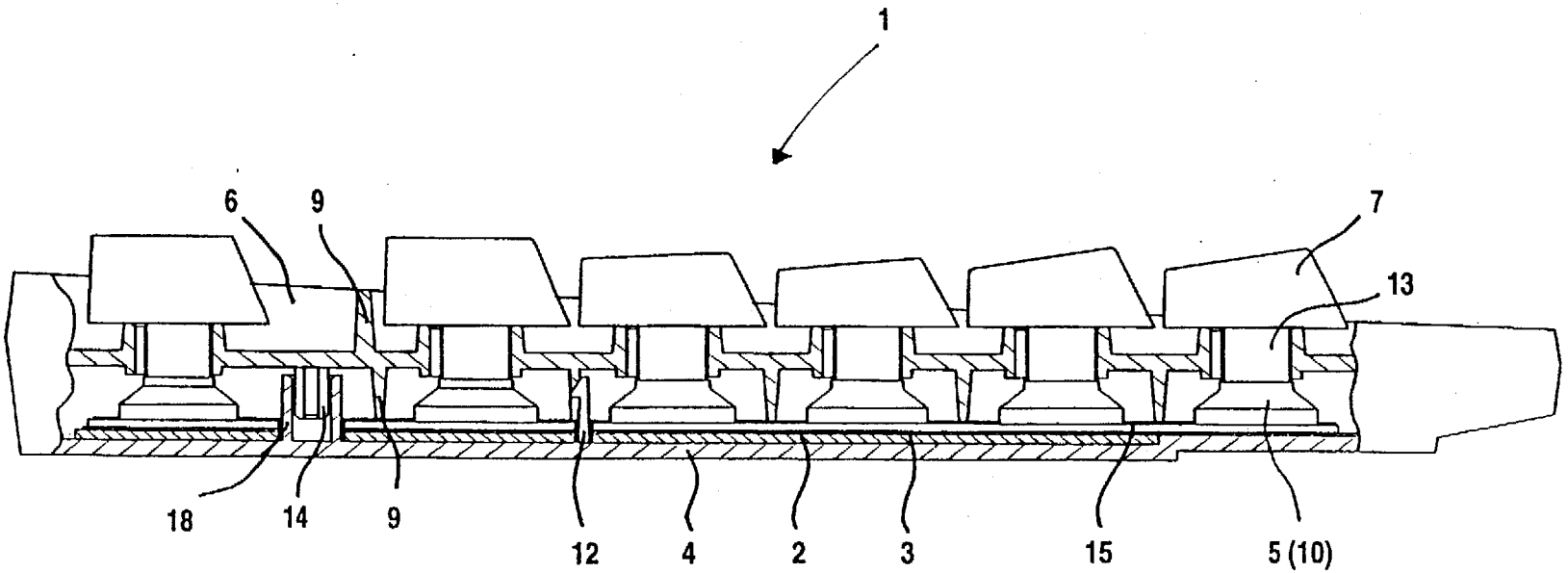
FIG. 1 is a partially sectional side view of the keyboard including a switch pad with switch domes which extend through openings formed in a planar stabilizing element disposed above the switch pad.

FIG. 1 shows in a partial cross-sectional view a keyboard 1 with a metal plate 2 which is form-lockingly received in a cavity in the lower housing part 4 and which increases the rigidity of the keyboard and improves the electromagnetic shielding of the interior of the housing. The metal plate 2 has a multi-layer switch foil set 3 disposed thereon. Keys 7 are disposed in the housing top part 6 so as to be vertically movable therein. At their bottom sides these keys 7 have slide pins 13 which are disposed on the tops of switch domes 10 which are formed integrally from a switch pad 5 consisting of an elastomer material. The switch pad 5 is disposed on top of the uppermost switch foil.

Figure 2:
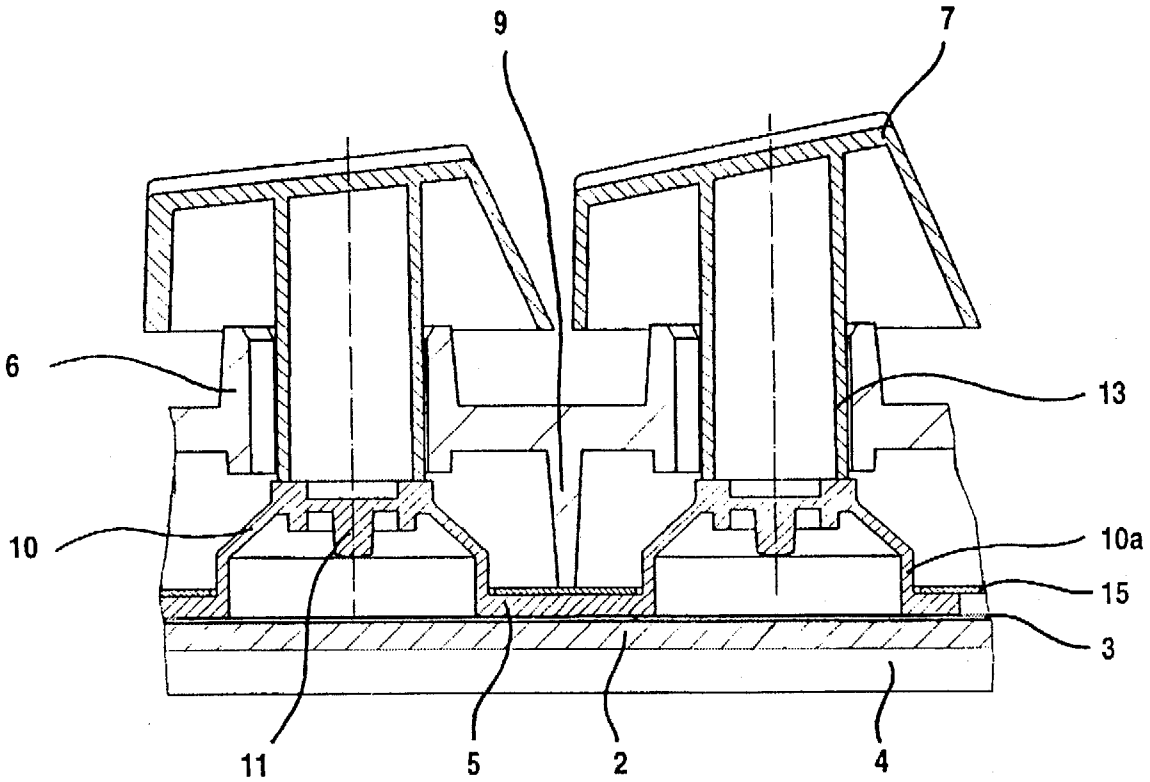
FIG. 2 is an enlarged sectional view extending through two switching heads.

FIG. 2 is an enlarged sectional view of the support arrangement for two keys 7 taken along a plane extending parallel to view plane of FIG. 1.

Since the switch foil set 3 is essentially known it is described here only to the extent as needed for an understanding of the invention: the switch foil set 3 comprises two outer switch foils and a spacer foil disposed between the two switch foils which holds the two switch foils at a distance from one another so as to electrically insulate them from one another. (Because of the scale utilized the single foil set layers are not visible in FIGS. 1 and 2).

In the area of the pressure points where the projections 11 within the switch domes 10 press onto the upper switch foil when the keys 7 are actuated the spacer foil is provided with openings. When a projection 11 is pressed onto the upper switch foil an electric contact structure disposed on the bottom side of the upper contact foil below the projection 11 is pressed through the respective opening in the spacer foil onto a corresponding electric contact structure formed on the lower switch foil so that an electric contact is established between the particular contact structures of the upper and the lower switch foils. When the key 7 is released the return forces effective in the elastic material of the switch pad 5 return the switch dome and accordingly, the keys 7 to their rest positions. At the same time, the upper switch foil and the lower switch foil also return to their spaced rest positions as a result of the return forces inherent within and because of the spacer foil disposed within, and because of the spacer foil disposed between, them. In their rest positions, the switch foils are separated by the spacer foil so that the contact between the upper and lower switch foils is interrupted.

Figure 3:
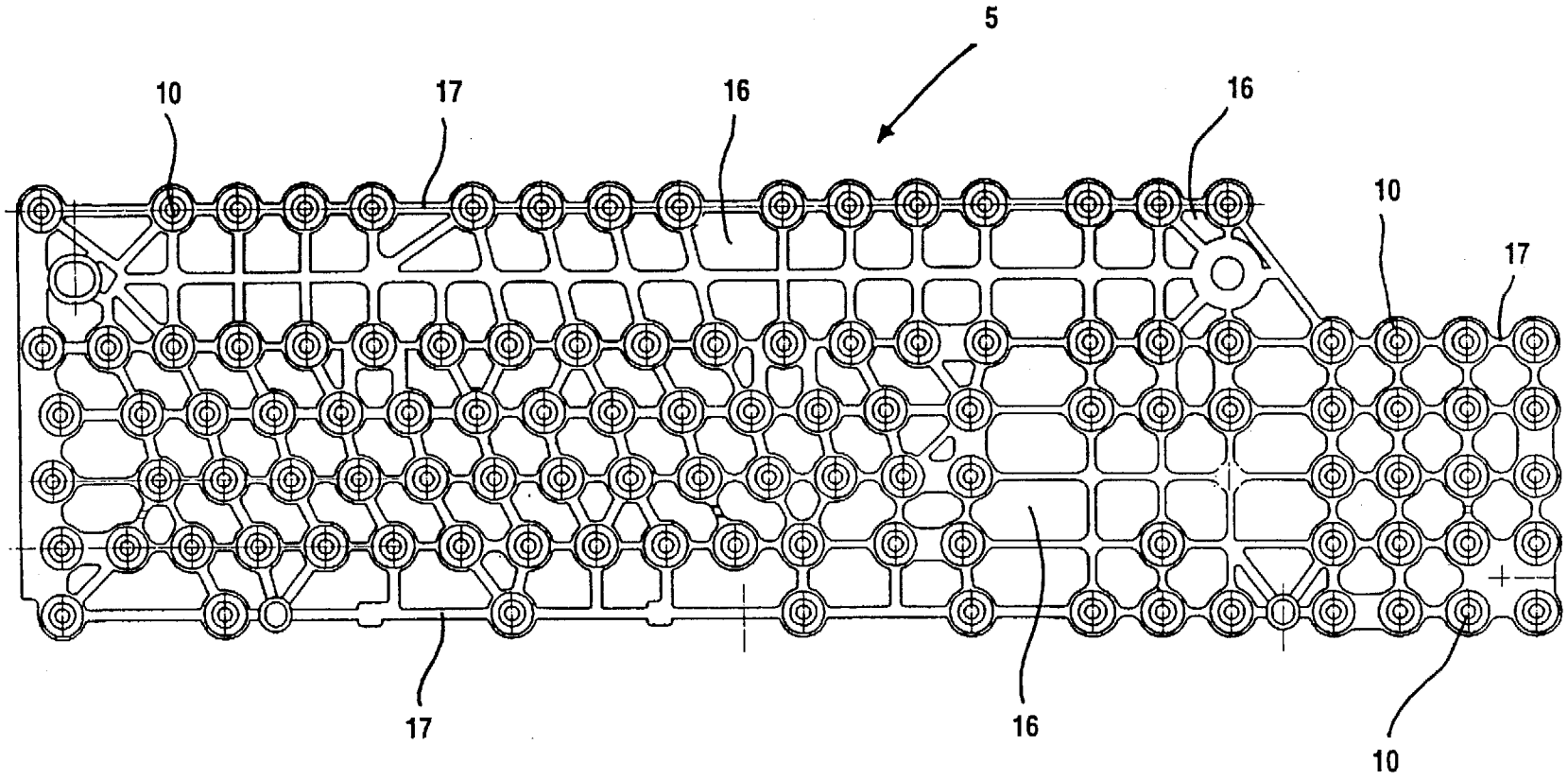
FIG. 3 is a top view of the switch pad with net-like interconnected switch domes as used in the keyboard shown in FIG. 1.

FIG. 3 is a top view of the switch pad 5 used in the keyboard 1 shown in FIG. 1 with switch domes 10 which are interconnected net-like by webs 17. With this net-like structure of the switch pad 5 substantially less material is required in comparison with a sheet-like pad since material is only used for the net structure while, in the area of the openings 16, the material is saved. This greatly reduces the expenses for the material so that the costs attributable to the switch pad 5 are reduced.

The loss of mechanical strength of the switch pad 5 would normally result in a reduced reliability of the switching functions of the switch pad since the switch domes are interconnected only by the relatively thin webs and, consequently, are not sufficiently firmly held in their relative positions. They could therefore not prevent sliding of the projections 11 off the contact points on the switch foil set 3 below. However, this problem is eliminated with the keyboard according to the invention by providing a sheet-like stabilizing element 15 preferably in the form of a thin foil or plate on top of the net-like switching pad 5.

The stabilizing element 15 has a plurality of openings which are formed at the locations of the switch domes and which surround the flange-like base portions 10*a* of the respective cupola-like switch domes 10. Consequently, the switch domes 10 are held in their proper positions and, at the same time, the switch pad 5 is prevented from shifting sideways or from being deformed.

Inspite of a loss of internal stability because of the relatively large openings 16, the switch pad 5, which in this way is fixed in position by the stabilizing element 15, is sufficiently reliable for transmitting the switching functions from the projections from the projections 11 of the switch domes 10 to the switch foil set 3 disposed below as the switch domes 10 are pushed downwardly by the slide pins 13 of the keys 7.

Since the stabilizing element 15 may consist of inexpensive materials, the additional costs for the stabilizing element 15 are small compared with the material cost savings achieved by the net-like configuration of the switch pad 5. The use of such a stabilizing element is also with respect to manufacturing practices less involved and less expensive than other possible solutions such as cementing the net-like switch pad 5 to the switch foil set 3 below.

The stabilizing element 15 may be fixed in position by reinforcement ribs 9 which project downwardly from the inner surface of the upper housing part 4 and of which at least same engage the upper side of the stabilizing element 15 as shown in FIG. 2.

The stabilizing element 15 and accordingly also the net-like switch pad 5 and also the switch foil set 3 can be even more firmly held in position if the reinforcement ribs 9 are engaged by engagement members 12 projecting from the bottom part of the housing and engaging the reinforcement ribs as indicated in FIG. 1.

A particularly good position stabilization of the stabilizing element 15 and also for the net-like switch pad 5 and the switch foil set 3 is obtained if the housing top part 6 is provided with downwardly projecting pegs 14 which, upon assembly of the housing, are engaged in sleeve-like receiving elements 18 which are integrally formed with the lower housing part and which project through corresponding openings in the metal plate 2, the switch foil set 3, the net-like switch pad 5 and the stabilizing element 15. This arrangement also facilitates assembly of the keyboard as the metal plate 2, the switch foil set 3, the net-like switch pad 5 and the stabilizing element 15 can be placed, during assembly, onto the housing bottom part 4 such that their corresponding openings fit onto the sleeve-like receiving elements 18 of the housing bottom part 4. In this way all components are properly positioned on the lower housing part and firmly held in their proper position already during assembly. Subsequently, the top housing part 6 with the reinforcement ribs 9 is placed onto the bottom housing part 4 whereby the reinforcement ribs 9 engage the topside of the stabilizing element 15 such that the stabilizing element 15, the net-like switch pad 5, the switch foil set 3 and the metal plate 2 are all held down and fixed thereby against movement in any direction.

All together, a keyboard according to the invention is relatively inexpensive but still of a highly sturdy design for reliable operation of the keyboard.

What is claimed is:

1. A keyboard comprising a housing including lower and upper housing parts, a metal plate form-lockingly disposed in said lower housing part, a switch foil set disposed in said lower housing part on top of said metal plate, keyboard keys supported in said upper housing part so as to be movable therein, a switch pad disposed on top of said switch foil set and having resilient switch domes disposed below said keys and projecting upwardly for resiliently supporting said keys, said switch pad having openings formed therein between said resilient domes such that said switch pad comprises a net-like structure with narrow webs disposed between said resilient switch domes, and a flat plate-like stabilization element disposed on said switch pad and having openings at the locations of said switch domes, said stabilization element receiving said switch domes and firmly retaining said switch domes in proper positions below said keys.

2. A keyboard according to claim 1, wherein said upper housing part has reinforcement ribs which extend downwardly so as to abut said stabilizing element and said lower housing part has upwardly projecting engagement members engaging at least some of said reinforcement ribs.

3. A keyboard according to claim 1, wherein said upper housing part has downwardly projecting pegs and said lower housing part has upwardly projecting sleeve-like receiving elements which fittingly extend through corresponding openings formed in said metal plate, in said switch foil set, in said net-like switch pad and in said stabilizing element and firmly engage said downwardly projecting pegs.

* * * * *